US006921158B2

(12) United States Patent
Zhang

(10) Patent No.: US 6,921,158 B2
(45) Date of Patent: Jul. 26, 2005

(54) FLUID EJECTION DEVICE WITH DROP VOLUME MODULATION CAPABILITIES

(75) Inventor: Hongsheng Zhang, San Diego, CA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/463,712

(22) Filed: Jun. 16, 2003

(65) Prior Publication Data

US 2003/0231231 A1 Dec. 18, 2003

Related U.S. Application Data

(63) Continuation of application No. 10/051,434, filed on Jan. 18, 2002, now Pat. No. 6,601,948.

(51) Int. Cl.[7] ..... B41J 2/045

(52) U.S. Cl. ..... 347/68; 347/71; 347/72; 347/48

(58) Field of Search ..... 347/68–72, 48

(56) References Cited

U.S. PATENT DOCUMENTS

| | | | | |
|---|---|---|---|---|
| 3,946,398 | A | | 3/1976 | Kyser et al. |
| 4,393,384 | A | | 7/1983 | Kyser |
| 4,513,299 | A | | 4/1985 | Lee et al. |
| 4,730,197 | A | | 3/1988 | Raman et al. |
| 5,252,994 | A | * | 10/1993 | Narita et al. ..... 347/71 |
| 5,726,690 | A | | 3/1998 | Bohorquez et al. |
| 5,731,828 | A | | 3/1998 | Ishinaga et al. |
| 5,894,317 | A | * | 4/1999 | Usui et al. ..... 347/72 |
| 5,933,168 | A | | 8/1999 | Sakai |

FOREIGN PATENT DOCUMENTS

| | | | |
|---|---|---|---|
| EP | 0 516 284 | | 2/1992 |
| EP | 0 869 002 | | 7/1998 |
| EP | 0 857 572 | | 12/1998 |
| EP | 0947 327 | | 6/1999 |
| EP | 0 940 256 | | 8/1999 |
| JP | 402162048 A | * | 6/1990 |
| JP | 10-138471 | | 5/1998 |

* cited by examiner

*Primary Examiner*—Stephen D. Meier
*Assistant Examiner*—Lam Nguyen
(74) *Attorney, Agent, or Firm*—Mark W. Croll, Esq.; Donald J. Breh, Esq.; Welsh & Katz, Ltd.

(57) ABSTRACT

An inkjet printhead has a piezoelectric module including a plate with an integrated ink chamber in flow communication with an integrated ink supply manifold and an integrated ink orifice. The ink chamber includes a main channel that connects the ink supply manifold to the ink orifice, and multiple piezoelectric actuators depending from the main channel and spaced apart by ink subchannels in flow communication with the main channel. The printhead also includes a ground electrode in contact with a first end of each of the actuators, and a cover plate bonded to the piezoelectric plate to seal the chamber and the manifold, the cover plate being in contact with a control electrode and configured to conduct control signals from the control electrode to the actuators. The invention also includes an inkjet printhead having a piezoelectric actuator capable of both vertical and horizontal deformation in direct communication with an ink supply and ink manifold to an ink ejection orifice. A controller supplies a signal to the piezoelectric actuator.

3 Claims, 4 Drawing Sheets

FLUID EJECTION DEVICE WITH DROP VOLUME MODULATION CAPABILITIES

CROSS-REFERENCE TO RELATED APPLICATION DATA

This application is a continuation of U.S. patent application Ser. No. 10/051,434, filed Jan. 18, 2002 now U.S. Pat. No. 6,601,948.

BACKGROUND OF THE INVENTION

The present invention relates to a piezoelectric fluid ejecting device, such as an inkjet printhead and methods of manufacturing the same. More particularly, the present invention relates to fluid ejecting devices in which the drop volume can be modulated.

There is a need for a piezo-electric printhead in which drop volume can be modulated. Desirably, such a printhead is configured to permit ready access to internal as well as external contacts between the actuators and electrodes. Most desirably, such a printhead can be fabricated in a "stacked" configuration to achieve high resolution print quality. It is also contemplated that such a device can be used to eject fluids other than ink, such as adhesives and the like. The present invention meets the above needs and has additional benefits as described in detail below.

SUMMARY OF THE INVENTION

In one embodiment, this invention achieves fluid drop formation and ejection with multiple actuators within a given fluid chamber. Each actuator is permitted to deform in multiple directions that all contribute to chamber volume change and ejection of the drop. In a current embodiment, such a device is configured for formation and ejection of ink drops. Other fluids are, however, contemplated, such as adhesives and the like.

Additionally, the multiple actuators can be selectively deformed to vary drop volume to achieve, for example, gray-scale printing. Varying drop volume cover plate seals the chamber and the manifold. The cover plate is in contact with a control electrode and is configured to conduct control signals from the control electrode to the actuators.

This and alternative embodiments of the present invention can also include one or more of the following features: the piezoelectric module can include multiple ink chambers disposed on the piezoelectric plate, with successive chambers being separated by a chamber wall; the ink chambers can be in flow communication with a common ink supply manifold; the chamber walls can be separated by a cut between successive chambers.

An elastic membrane can be disposed between the cover plate and the piezoelectric plate. The elastic membrane can be electrically conductive, or parts of the elastic membrane can be electrically conductive based upon the arrangement of the actuators. The actuators can be selectively activated to modulate ink drop size. A restrictor can be disposed between the manifold and the main channel.

Multiple modules can be stacked together on the printhead. The stacked modules can be offset from each other. The actuators can be disposed perpendicular to the main channel. The actuators can be elongated toward the ink orifice. The first end of each actuator can tapered. The actuators can be shorter than the surrounding chamber walls. The actuators can be arranged parallel to each other.

In another embodiment, the present invention contemplates an inkjet printhead having means for piezoelectric actuation capable of both vertical and horizontal deformation in direct communication with means for supplying ink from an ink manifold to an ink ejection orifice and control means for supplying a signal to the piezoelectric actuation means.

The inkjet printhead also can include means for restricting the flow of ink between the ink supply means and the manifold. The inkjet printhead also can include multiple piezoelectric actuation means stacked together on a single printhead. The stacked actuation means also can be offset from each other.

In another embodiment, the present invention contemplates a method of controlling ink drop volume in an inkjet printhead including the steps of selectively activating one or more piezoelectric actuators in an array of piezoelectric actuators in direct communication with an ink supply to create a pressure wave that propagates through the ink supply and ejects an ink drop the volume of which is dependent on the number of actuators that are activated.

In this method, the actuators can be selectively activated by a control electrode electrically connected to the actuators. An electrically conductive elastic membrane also can conduct signals from the control electrode to the actuators to selectively activate same.

In another embodiment, the present invention contemplates an inkjet printer having a piezoelectric printhead as described above.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
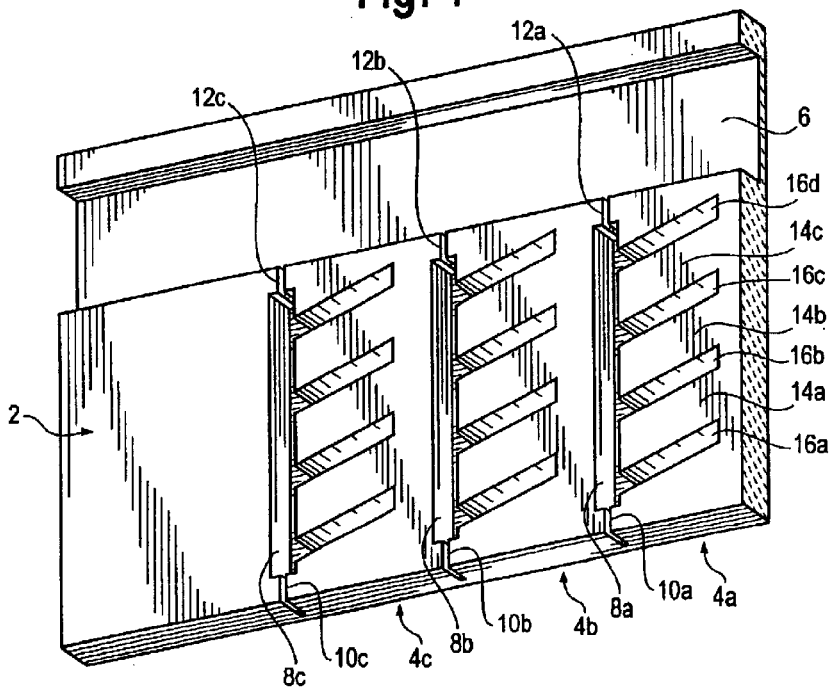
FIG. 1 is a perspective view of one embodiment of the inventive printhead.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to FIG. 1, it is seen that in one embodiment, the invention is directed to an inkjet printhead for an inkjet printer including a piezoelectric plate 2 with multiple integrated ink chambers 4*a*, 4*b*, 4*c* in flow communication with an integrated ink supply manifold 6. The ink chambers 4*a*, 4*b*, 4*c* respectively include main channels 8*a*, 8*b*, 8*c* that connect the ink supply manifold 6 at one end of the channels to ink orifices 10*a*, 10*b*, 10*c* at an opposite end thereof.

In a given ink chamber, such as ink chamber 4*a*, multiple piezo electric actuators 14*a*, 14*b*, and 14*c* depend from the main channel 8*a* and are disposed in a comb-like arrangement, with adjacent actuators 14*a*, 14*b*, 14*c* spaced apart by ink subchannels 16*a*, 16*b*, 16*c*, 16*d* in flow communication with the main channel 8*a*. The number of actuators in a given ink chamber preferably ranges from two (2) to twenty (20) or more, and which can be actuated separately and selectively to achieve drop size modulation and grayscale printing. Large-scale printing (on the order of 2–8 inches) without stitching is also possible because the same chamber pattern can be readily repeated on a relatively large and inexpensive ceramic plate, as compared to conventional silicon-based print heads in which costs increase significantly with increased size.

Restrictors 12*a*, 12*b*, 12*c* are disposed between the ink supply manifold 6 and the main channels 8*a*, 8*b*, 8*c*. The restrictors 12*a*, 12*b*, 12*c* control the flow of ink between the manifold 6 and the main channels 8*a*, 8*b*, 8*c*, and help to alleviate ink flow from the ink chambers 4*a*, 4*b*, 4*c* back into the manifold 6. This can be accomplished by a narrowing of the main channels 8*a*, 8*b*, 8*c* as it approaches the ink supply manifold 6, by a valve or by some other flow control device.

Figure 2:
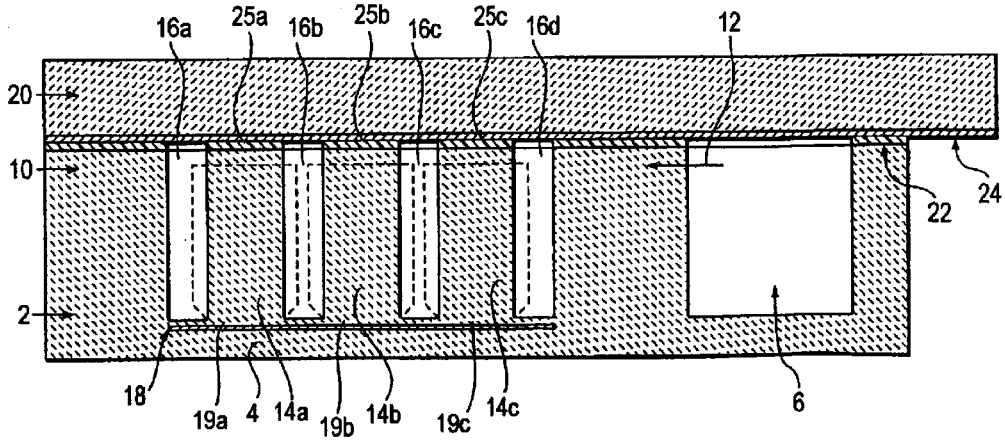
FIG. 2 shows a cross-sectional view of the working mechanism of the actuators.
Figure 3:
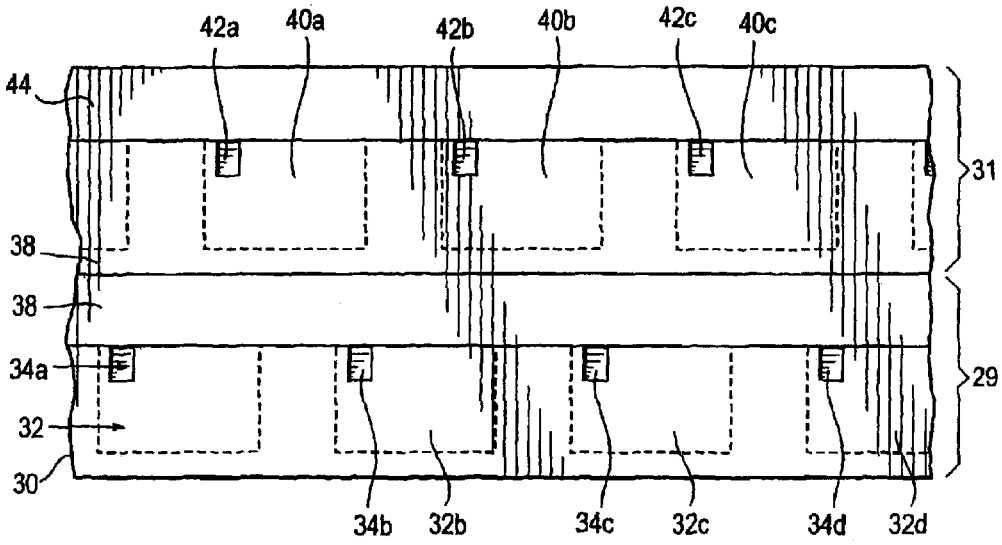
FIG. 3 shows the front view of a stacking arrangement for high-resolution applications.
Figure 4:
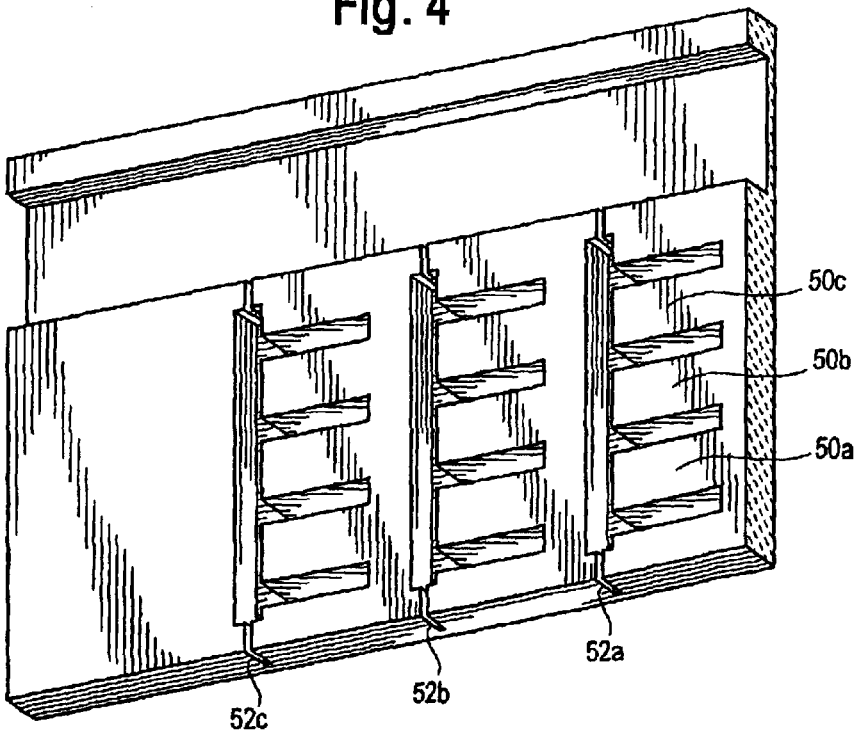
FIG. 4 shows an alternative embodiment in which actuators are perpendicular to ink channels for easier cutting.
Figure 5:
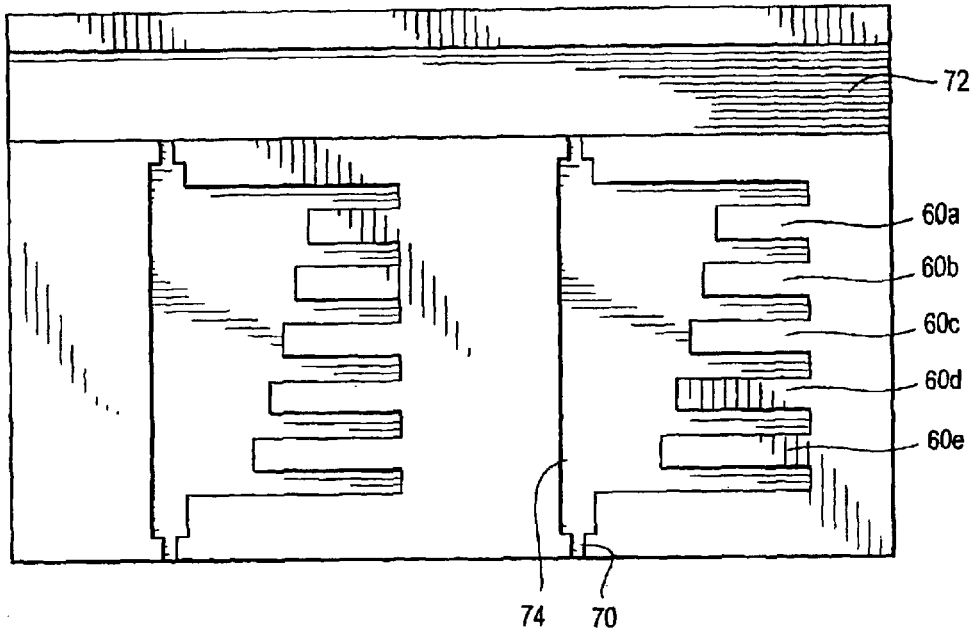
FIG. 5 shows an alternative embodiment in which actuators become longer toward the orifice to form a larger ink chamber.

Referring now to FIG. 2, it is seen that a common electrode or ground 18 is in contact with a first end 19 of each of the actuators. A cover plate 20 seals the ink chamber 4 and manifold 6. The cover plate 20 can be bonded to the piezoelectric plate 2 with a conductive elastic material 22. The cover plate 20 also contacts a control electrode 24 and conducts control signals from the control electrode 24 to individual electrodes 25*a*, 25*b*, 25*c* at a second end of the actuators 14*a*, 14*b*, 14*c*, which for example can be the top end of the actuators, such that the actuators 14*a*, 14*b*, 14*c* can be activated to cause an ink drop to eject through the orifice 10. In a preferred embodiment, the individual actuators 14*a*, 14*b*, 14*c* can be selectively activated to control the volume of the resultant ink drop. The volume of the ink drop increases in relation to the number of actuators that are activated.

When a voltage is applied between the control electrode 24 and the ground 18, the actuator 14 shrinks in the vertical direction (away from the cover plate), but expands horizontally into the adjoining subchannels 16 as shown by the dashed lines in FIG. 2. In this example the electric field is applied in a direction that is parallel to the piezoelectric poling direction. During this actuation step, the elastic material 2 is pulled down along with the actuators 14. Ink between actuators 14 is thus squeezed and pushed out of the ink chambers toward the respective orifices to expel an ink drop.

The cover plate 20 can be any suitable material that is compatible with the piezoelectric material and can be coated or plated with metal, if this longer toward the orifice 70 to increase the capacity of the ink chamber 74.

Figure 6:
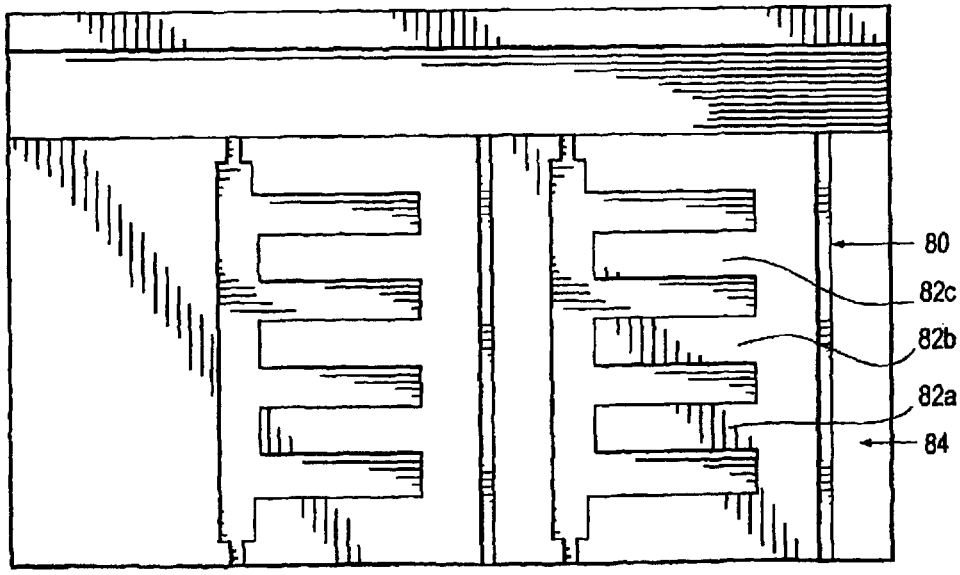
FIG. 6 shows a shallow cut to separate actuators from the wall.

Referring now to FIG. 6, it is seen that a shallow cut 80 can be used to separate actuators 82*a–c* from successive chamber walls 84. This cut 80 also helps to avoid deformation of the chamber walls 84, which may cause cross-talk between adjacent chambers.

Figure 7:
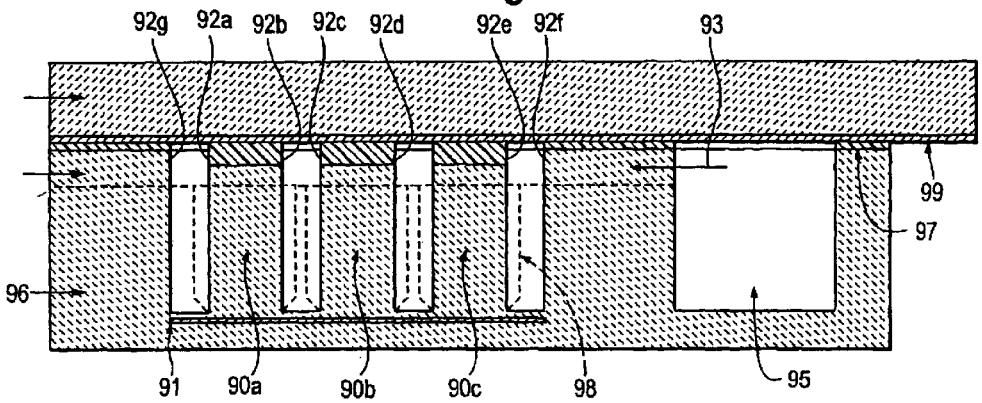
FIG. 7 shows an alternative embodiment where actuators are shorter than the surrounding walls.

Referring now to FIG. 7, it is seen that in yet another embodiment, the actuators 90*a–c* are shorter than the surrounding walls 92*a–d*. The actuators 90*a–c* can be shortened in relation to the surrounding walls 92*a–d* by ablation before all chambers are formed. Shortening the actuators 90*a–c* in relation to the surrounding walls 92*a–d* increase the rigidity of cover plate 94 and chamber plate 96 bonding without sacrificing the freedom of individual actuators 90*a–c*. Also shown are ground electrode 91, restrictor 93, ink manifold 95, control electrode 99 and elastic material 97 that bonds the cover plate to the piezoelectric plate and also conducts electricity from the control electrode to the individual actuators 90*a–c*. The dotted lines show the piezoelectric material contracting in the vertical direction and expanding in the horizontal direction in response to signals from the control electrodes.

Figure 8:
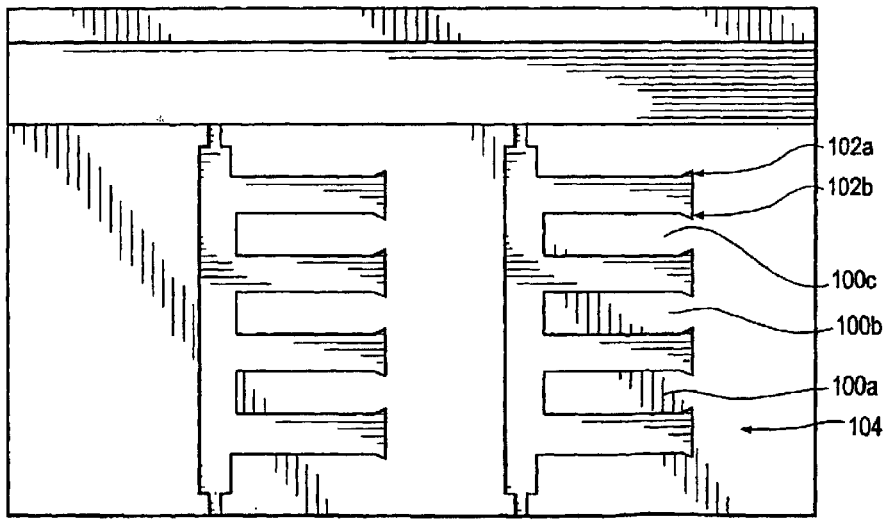
FIG. 8 shows an alternative embodiment with additional cuts around the cover to allow for additional actuator deformation.

Referring now to FIG. 8, it is seen that in an other embodiment, additional cuts 102*a–b* are made around the corners of the base of the actuators 10*a–c*, where the actuators meet the chamber wall 104. The resulting tapered actuators 100*a–c* allow for additional deformation space and hence greater ink displacement.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inserted. The disclosure is intended to cover by the appended claims all such modifications as fall within the scope of the claims.

What is claimed is:

1. An inkjet printhead comprising:

multiple piezoelectric actuation means for piezoelectric actuation capable of both vertical and horizontal deformation in direct communication with means for supplying ink from an ink manifold to an ink ejection orifice, the multiple piezoelectric actuation means being stacked together on a single printhead; and control means for supplying signal to the piezoelectric actuation means;

wherein the multiple piezoelectric actuation means, when actuated, eject ink from a common ink ejection orifice.

2. The inkjet printhead of claim 1 further comprising means for restricting the flow of ink between the ink supply means and the manifold.

3. The inkjet printhead of claim 1 wherein the stacked actuation means are offset from each other.

* * * * *